United States Patent [19]

Bollinger

[11] Patent Number: 4,820,138

[45] Date of Patent: Apr. 11, 1989

[54] GEAR-WITHIN-GEAR FUEL PUMP AND METHOD OF PRESSURE BALANCING SAME

[75] Inventor: Steven R. Bollinger, County of St. Louis, Mo.

[73] Assignee: Carter Automotive Company, Inc., St. Louis, Mo.

[21] Appl. No.: 101,265

[22] Filed: Sep. 25, 1987

[51] Int. Cl.[4] ..... F04C 2/10

[52] U.S. Cl. ..... 418/71; 418/171

[58] Field of Search ..... 418/71, 171, 166; 417/410

[56] References Cited

U.S. PATENT DOCUMENTS

| | | | |
|---|---|---|---|
| 2,132,813 | 10/1938 | Wahlmark | 418/71 |
| 3,680,989 | 8/1972 | Brundage | 418/171 |
| 4,199,305 | 4/1980 | Pareja | 418/171 |
| 4,462,761 | 7/1984 | Ringwald | 417/203 |
| 4,526,518 | 7/1985 | Wiernicki | 417/420 |
| 4,580,951 | 4/1986 | Carleton et al. | 417/366 |
| 4,596,519 | 6/1986 | Tuckey | 418/15 |
| 4,619,588 | 10/1986 | Moore, III | 417/366 |
| 4,629,399 | 12/1986 | Friebe | 417/201 |
| 4,642,030 | 2/1987 | Friebe et al. | 417/203 |
| 4,645,430 | 2/1987 | Carleton | 417/359 |
| 4,662,827 | 5/1987 | Wiernicki | 417/363 |

*Primary Examiner*—Leonard E. Smith
*Assistant Examiner*—Leonard P. Walnoha
*Attorney, Agent, or Firm*—Robert F. Hess; Lawrence J. Shurupoff

[57] ABSTRACT

A gear-within-gear positive displacement pump, such as an automotive fuel pump, is disclosed having a pump chamber, an internal gear within the pump chamber, and an external gear within the internal gear. The pump chamber has an inlet and an outlet. The external gear is rotatably driven thereby causing the internal gear to rotate and further causing the teeth of the internal and external gears to unmesh thereby drawing fluid into the pump chamber between the gears and further causing the teeth of the gears to mesh so as to positively force the fluid out of the pump chamber. A pressure balancing passage way is provided between the portion of the pump housing in which the gear teeth mesh thereby permitting fluid under pressure to be directed to the exterior of the internal gear so as to pressure bias the internal gear generally toward the inlet and to at least in part balance the pressure forces on the internal gear with a consequent reduction of noise and increase in pump efficiency. A method of pressure balancing the forces on the internal gear is also disclosed.

1 Claim, 2 Drawing Sheets

GEAR-WITHIN-GEAR FUEL PUMP AND METHOD OF PRESSURE BALANCING SAME

BACKGROUND OF THE INVENTION

This invention relates to a gear-within-gear pump and more particularly to such a gear-within-gear fuel pump for automotive fuel systems or the like.

Heretofore, gear-within-gear fuel pumps, generally similar to that shown in FIGS. 1–4 of the drawings herein, were on sale and in public use more than one year prior to the filing date of the instant application. However, it was found that the pumping elements (i.e., the gear-within-gear pumping elements and the motor) grew progressively more noisy as the pumping elements became worn. Since many of these fuel pumps are utilized in electronic fuel injection systems for relatively expensive cars, and since oftentimes the fuel pump will operate for some short time prior to starting the engine of the car, automobile manufacturers and automobile owners were sensitive to the noise generated by such fuel pumps.

It has been found that a certain portion of the noise generated by such fuel pumps is caused because excessive tolerances between the effective diameters of the external and internal gears, and because of the necessary spaces between the outer periphery of the internal gear and the inner wall of the eccentric ring which receives the internal gear.

During testing of such gear-within-gear fuel pumps, the pumping elements were found to become more noisy and they "wore in". It was also found that tolerances between the external and internal gear and between the outer surface of the eccentric ring and the pump housing tended to change which, in turn, decreased the compression ratio of the pump and increased pump friction. In addition to increasing the noise levels of the pump, such changes in dimensions adversely affected the flow capacity and efficiency of the pump.

SUMMARY OF THE INVENTION

Among the several objects and features of this invention may be noted the provision of a gear-within-gear pump, and particularly a gear-within-gear fuel pump for automotive applications, which is significantly quieter than similar prior art gear-within-gear fuel pumps of similar construction and which remains quiet throughout its intended service life;

The provision of such a gear-within-gear pump which has a greater capacity and a higher efficiency than similar pumps of substantially identical size and power consumption;

The provision of such a gear-within-gear pump in which the system for quieting the pump is of simple construction, and has no moving parts, and compensates for wear and manufacturing tolerances;

The provision of a method of pressure balancing a gear-within-gear pump for reducing noise of operation of the pump and for simultaneously increasing the discharge capacity and efficiency of the pump; and The provision of such a gear-within-gear pump which has a long service life, is of reliable operation, is economical to manufacture, is of compact size so that it may be installed within an automotive fuel tank; and is of comparable cost as similarly sized prior art gear-within-gear pumps.

Other objects and features of this invention will be in part apparent and in part pointed out hereinafter.

Briefly stated, this invention relates to a gear-within-gear pump, and particularly to an automotive gear-within-gear fuel pump. The pump comprises a driver or motor, a base secured to the driver, an inlet end spaced from the base, and pump housing defining a pump chamber between the base and the inlet end. An inlet opening is provided in the inlet end and an outlet opening is provided in the base with the inlet and outlet openings being in communication with the pump chamber and being angularly offset from one another about the pump chamber. The pump chamber has a curvilinear (or generally circular) outer wall. An internal gear having a curvilinear (or generally circular) outer periphery is received within the pump chamber and the internal gear has a sliding, sealing fit with the outer wall of the pump chamber. The internal gear has a plurality of internal gear teeth. An external gear is received within the internal gear and the external gear has a plurality of external gear teeth disposed for meshing with at least certain of the internal gear teeth. A means providing communication between a space between the external and internal gears and the outer circular periphery of the internal gear and the circular wall of the pump chamber is provided with this means pressure biasing the internal gear generally toward the inlet opening so as to at least in part balance the pressure forces on the internal gear.

The method of this invention relates to the pressure balancing of a gear-within-gear pump. The pump is essentially as described above and the method involves rotatably driving the external gear thereby to cause the internal gear to rotate with the external gear and with respect to the pump chamber. Upon driving the external gear, the teeth of the internal and external gears are caused to unmesh thereby to draw fluid into the pump chamber from the inlet opening and are further caused to mesh thereby to force the fluid from between the gears via the outlet opening. Fluid pressure is communicated from between the external and internal gears proximate the outlet opening to a space between the outer periphery of the internal gear and the pump housing for biasing the internal gear generally toward the inlet opening thereby to at least in part balance the pressure forces on the internal gear.

BRIEF DESCRIPTION OF THE DRAWINGS

Corresponding reference characters indicate corresponding parts throughout the several views of the drawings.

DESCRIPTION OF PREFERRED EMBODIMENT

Figure 1:
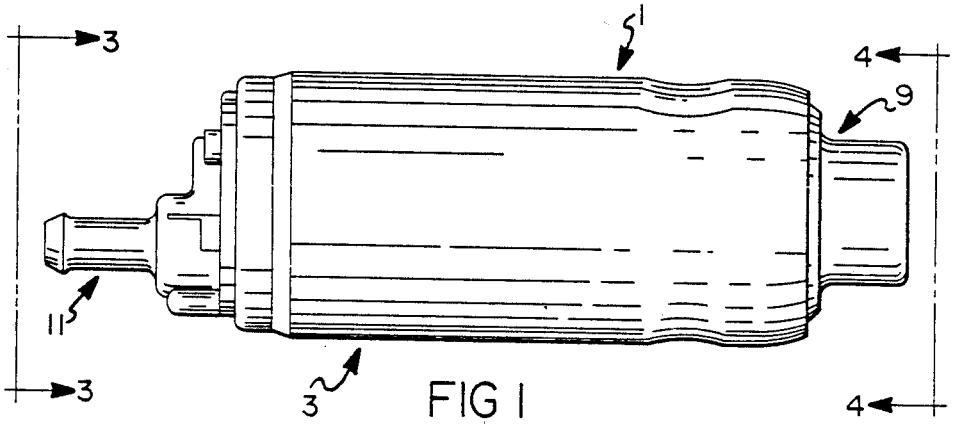
FIG. 1 is a side elevational view of a gear-within-gear automotive fuel pump of the present invention.

Referring now to the drawings, and particularly to FIG. 1, a gear-within-gear automotive fuel pump of the present invention is indicated in its entirety by reference character 1. While this invention is described in the environment of an automotive gear-within-gear fuel pump, it will be understood that, within the broader aspects of this invention, this invention may be applicable with other types of so called gear-within-gear pumps and with other similar fluid power applications.

More specifically, pump 1 has a housing or shell, as indicated at 3, surrounding the pump and, in a manner as hereinafter will appear, is sealed to the inlet and outlet ends of the pump. A permanent magnet electric motor, as indicated at 5, is received within housing 3 and constitutes a driver for the pump. Motor 5 has a drive shaft 7 extending endwise from one end therefrom for driving pump 1. It will be understood that the construction of motor 5 is not critical to the present invention and thus a detailed description of the motor has been omitted for purposes of brevity.

Pump 1 includes an inlet, as generally indicated at 9, at one end of the pump and an outlet, as indicated at 11, at the other end of the pump such that the fluid (e.g., a petroleum-based fuel, such as gasoline, diesel fuel, gasahol, or the like) is drawn into the pump via inlet 9, forced axially through the pump over, around, and through motor 5, and is forceably discharged under pressure from outlet 11.

Figure 2:
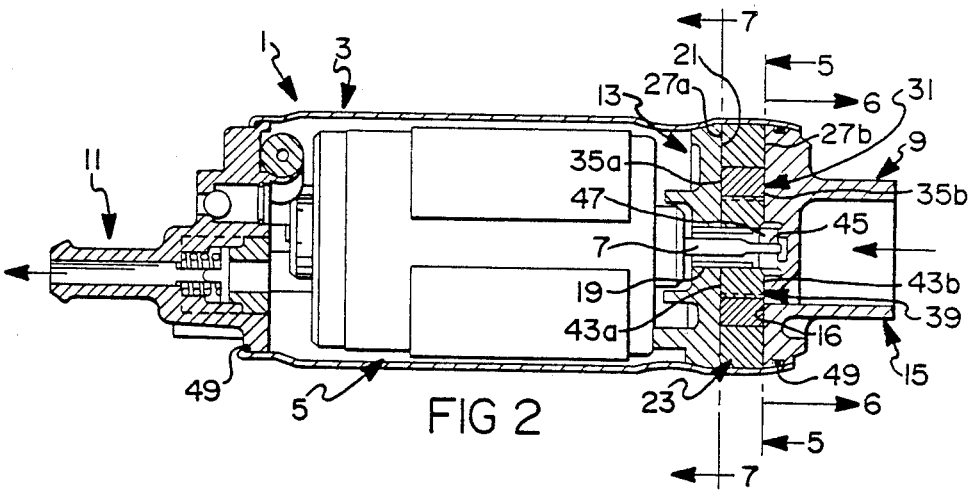
FIG. 2 is a longitudinal cross-sectional view of the pump illustrated in FIG. 1.
Figure 3:
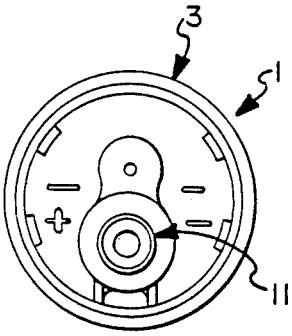
FIG. 3 is a left end elevational view of FIG. 1.
Figure 5:
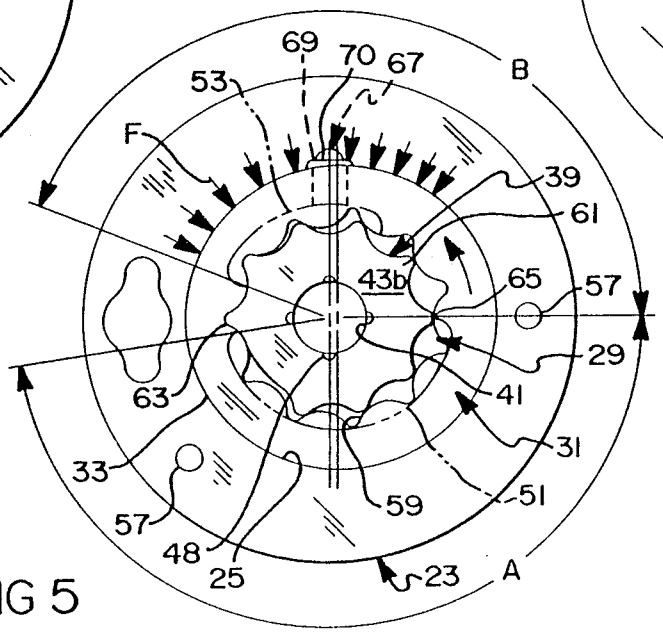
FIG. 5 is a cross-sectional view taken along line 5—5 of FIG. 2 illustrating, on an enlarged scale, an external gear in mesh with an internal gear and with the internal gear being journaled within a curvilinear opening of an eccentric ring or pump housing, with this eccentric ring defining a pump chamber.

A base 13, preferably of suitable synthetic resin material, is positioned adjacent one end of motor 5 and is held is desired axial position with respect to the motor by means of housing 3. An inlet end 15 is spaced axially outwardly from base 13 and is held in a desired spaced relation to base 13 by housing 3. The inlet end has an inwardly facing flat face 16. Inlet end 15 is also formed of a suitable synthetic resin material. Base 13 is provided with a central opening 17 (see FIG. 7) which receives a sleeve or bushing 19 (see FIG. 2) which in turn journals drive shaft 7 therewithin. The outer face 21 of base 13 is formed (e.g. lapped) so as to constitute a true planar surface for purposes as will appear. An eccentric ring 23 of suitable metal or the like is interposed between base 13 and inlet end 15. As shown in FIG. 5, eccentric ring 23 has an inner curvilinear (i.e., generally circular) wall 25 therein. Ring 23 has a pair of axially disposed flat walls 27*a*, 27*b* parallel to one another in face-to-face engagement with face 21 of base 13 and with face 16 of inlet end 15. A pump chamber 29 is defined by the inner curvilinear wall 25 of eccentric ring 23 and the spaced flat outer face 21 of base 13 and the flat inwardly facing face 16 of the inlet end 15.

An internal gear, as generally indicated at 31, is received in eccentric ring 23 with this internal gear having an outer curvilinear (or generally circular) periphery 33 which is slidingly, sealingly engageable with the inner curvilinear wall 25 of eccentric ring 23, such that the internal gear is free to turn relative to the eccentric ring. Internal gear 31 has axially inwardly and outwardly facing flat faces 35*a*, 35*b* which, respectively, slidingly, sealingly engage the flat outer face 21 of base 13 and the flat, inner face 16 of inlet end 15.

An external gear, as indicated at 39, has a central aperature 41 which receives bushing 19 for journaling external gear 39 on base 13. External gear 39 has inner and outer flat faces 43*a*, 43*b*, which, respectively, slidingly, sealingly engage the flat outer surface 21 of base 13 and the flat inner face 16 of inlet end 15. It will be appreciated that the thicknesses of the internal and external gears are essentially identical, such that both gears are in sliding, sealing, engagement with the flat faces 21 and 16 of base 13 and inlet end 15, respectively, when the various components are assembled in the manner illustrated in FIG. 2.

Figure 6:
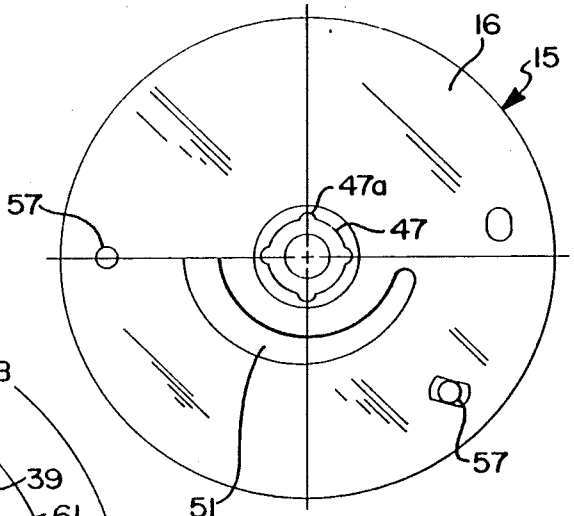
FIG. 6 is a view taken along line 6—6 of FIG. 2 illustrating, in enlarged scale, the inner end face of an outlet end.

Drive shaft 7 is provided with a flat 45 on its outer end. This flat engages a coupler 47 having lugs 47*a* (see FIG. 6) thereon which in turn engage receptacles 48 (see FIG. 5) in external gear 39 so as to cause the external gear to rotate with the drive shaft and to pump fluid through pump 1 in a manner as will appear. Seals 49 are provided on inlet end 15 and on outlet 11. It will be understood that with the construction of the pump illustrated herein, housing or shell 3 is magnetically or otherwise compressively formed in place on the inlet and outlet ends 15 and 11, respectively, so as to seal the inlet and outlet ends with respect to housing 3 and so as to securely hold motor 5, base 13, eccentric ring 23, internal gear 31, external gear 39, and inlet end 15 in the relation illustrated in FIG. 2 with the internal and external gears being in sliding, sealing, engagement with the flat faces 21 and 16 of base 13 and inlet end 15, respectively.

Figure 4:
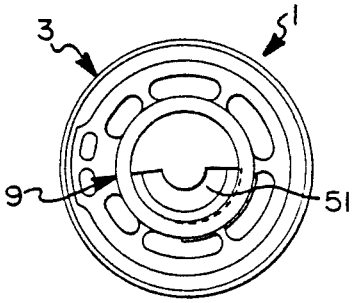
FIG. 4 is a right end elevational view of FIG. 1.
Figure 7:
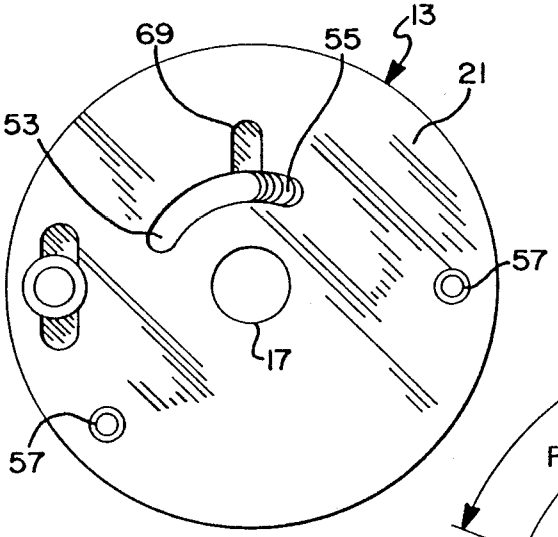
FIG. 7 is a view taken along line 7—7 of FIG. 2 illustrating, in enlarged scale, the outer end face of a base end.

An arcuate inlet opening 51 is provided in inlet end 15, as best shown in FIGS. 4 and 5. This arcuate inlet opening 15 extends over a considerable arc (almost 180°), and is in register with the intersection between internal gear 31 and external gear 39 for purposes as will appear. As shown in FIG. 7, base 13 has an arcuate outlet opening 53 therein. At the leading end of arcuate outlet opening 53 (as defined by the direction of rotation of internal gear 31), an inclined ramp 55 is provided serving as a transition between flat face 21 of base 13 and outlet slot 53 in communication with the interior housing 3.

Locating holes 57 are provided in base 13, in eccentric ring 23, and in outlet end 15 so as to assure that these components are assembled in desired angular and axial relation to one another such that the arcuate inlet opening 51 in inlet end 15 and the arcuate outlet opening 53 in base 13 are in communication with pump chamber 29, and such that the inlet end outlet openings are angularly offset from one another relative to the pump chamber with, generally, the inlet and outlet openings being on opposite sides of the pump chamber (as shown in FIG. 5). Locating pins (not shown) are received in locating holes 57 so as to positively hold the above identified components in desired angular and axial relation relative to one another.

As best shown in FIG. 5, internal gear 31 has a plurality of internal gear teeth or lobes 59 projecting generally radially inwardly from the internal gear. External gear 39 has a plurality of external gear teeth or lobes 61 projecting generally radially outwardly. Preferably, the inner, external gear 39 has one or more fewer teeth than the outer, internal gear. Such an arrangement constitutes a well known gear-within-gear unseparated pump. As the inner, external gear 39 is driven by drive shaft 7, the inner external gear drives the outer internal gear 31 such that the internal and external gear teeth 59 and 61 seal relative to one another at at least two points generally diametrically opposite one another, as indicated at 63 and 65. The direction of rotation of the outer, internal gear 31 is counterclockwise (as shown in FIG. 5) and as indicated by the arrows in FIG. 5.

Upon rotatably driving the inner, external gear 39, the outer, internal gear 31 rotates within pump chamber 29, causing the gear teeth 59 and 61 to unmesh from seal point 63 to seal point 65, thus creating a vacuum therebetween. This space between the unmeshing gear teeth 59 and 61 of the external and internal gears, as indicated generally by an intake segment A (FIG. 5), is in communication with inlet opening 51 in inlet end 15. Thus, a vacuum is created within this unmeshing space, and fluid is drawn into this space between the external and internal gears via inlet opening 51. The pockets between the gear teeth convey the fluid past sealing point 65. As the gear teeth move past sealing point 65, they begin to mesh with one another and thereto forceably discharge the fluid therebetween. This discharge segment of the gear-within-gear pump is illustrated in FIG. 5 as segment B and, this discharge segment B is in communication with the arcuate outlet opening 53 in base 13. Thus, as the gear teeth mesh from point 65 to point 63, the fluid therebetween is forceably discharged from the outlet opening 53 into the space within housing 3 surrounding motor 5 and fluid is discharged from pump outlet 11.

Such pumps, as described above are conventional and constitute prior art with respect to the present invention.

In accordance with this invention, means, as generally indicated at 67 and as shown in FIG. 5, is provided for pressure balancing the internal gear 31 (and the external gear 39) so as to result in the balanced, continuous operation of pump 1 with a consequent reduction of acoustical noise and with increased flow capacities and efficiencies, as compared with essentially identical prior gear-within-gear pumps, as heretofore described. More specifically, pressure balancing means 67 comprises a generally radial slot or groove 69 providing communication between the discharge segment B of pump chamber 29 and the curvilinear, inner wall 25 of eccentric ring 23 which in turn constitutes the curvilinear (or generally circular) outer wall of pump chamber 29. Another groove 70 is provided in wall 25 of eccentric ring 23 in communication with groove 69 for axially and radially distributing fluid pressure within the space between the outer wall or periphery 33 of internal gear 31 and inner curvilinear wall 25 of eccentric ring 23. By transmitting fluid pressure radially outwardly of the discharge segment B via groove 69 to the space between the outer surfaces of internal gear 31 and inner wall 25 of eccentric ring 23, hydraulic forces F (as indicated by the arrows in FIG. 5) are applied to one side of internal gear 31 which, at least in part, counteracts an imbalance of forces on the internal and external gears 31 and 39 caused by the vacuum created in inlet segment A and by the pressure created in discharge segment B as the gears are notably driven.

It has been found that by providing a path (e.g., groove 69) for communication of pressurized fluid between the internal and external gears in segment B, as above described, this counteracting pressure balancing force F significantly reduces acoustical noise of the pump during operation and automatically accommodates dimensional variations and wear thus enabling a quiet and smooth operation of the pump throughout its expected service life. Additionally, by applying fluid pressure via groove 69 between the rotating outer curvilinear wall of internal gear 31 and the inner curvilinear wall 25 of eccentric ring 23, it is ensured that adequate lubricant is provided between these moving curvilinear surfaces so as to significantly reduce friction between the internal gear and the eccentric ring. It has further been found that the clearances between the internal and external gear teet 59 and 61 are better maintained at at least the seal points 63 and 65 such that the compression ratio of the pump is maintained throughout a significantly larger range of dimensional tolerances of the various components of the pump thereby increasing pump capacity and pump efficiency, as compared to substantially identical pumps utilizing the same motor 5 and the same internal and external gears 31 and 39, respectively, without consuming additional electrical power.

For example, a pump, generally similar to the pump 1 illustrated and described herein, but not having the pressure balancing means 67, as heretofore described, was tested having 12 volts DC applied to the terminals of motor 5 and regulated so as to have an output pressure of 36 PSI. The flow rate of this pump was found to be 11 gallons per hour and the acoustical noise levels of the pump were determined to range between 72 and 74 dbA. A pump in accordance with this invention, of essentially the same configuration, but for the addition of pressure balancing slot 69, was also tested by applying 12 volts DC to the terminals of the motor and regulating the output to 36 PSI. The pump 1 of the present invention was found to operate at a noise level of about 70 dbA and to have a flow rate of 15 gallons per hour.

In view of the above, it will be seen that the various objects and features of this invention are achieved and other advantageous results obtained.

As various changes could be made in the above constructions and methods without departing from the scope of the invention, it is intended that all matter contained in the above description or shown in the accompanying drawing shall be interpreted as illustrative and not in a limiting sense.

What is claimed is:

1. A liquid pump (1) comprising a housing (3) that is internally contoured to define two parallel end faces (16 and 21) and an endless circular wall (25) extending therebetween, to define a cylindrical pump chamber; said endless circular wall defining a first axis; an internal driven ring gear rotatably seated on and within said circular surface for rotation around said first axis; an external pinion drive gear located within the ring gear for rotation around a second axis that is parallel to but offset from the first axis; said first and second axes defining an imaginary plane that subdivides the pump chamber into a first zone where teeth on the two gears gradually unmesh, and a second zone where teeth on the two gears gradually come into mesh; an arcuate liquid inlet opening in one of the aforementioned chamber end faces operable to feed liquid into the intertooth spaces in the first zone; an arcuate liquid outlet opening in one of the aforementioned end faces operable to discharge liquid from the intertooth spaces in the second zone; said endless circular surface having an axial groove therein located on a second imaginary plane that extends radially from said first axis through the outlet opening and normal to the first mentioned plane; and a passage continuously interconnecting said outlet opening and said axial groove, whereby said ring gear is continually pressure biased against liquid pressure forces generated in the intertooth spaces; said inlet opening extending around a major portion of said first zone; said outlet opening extending only around a minor portion of said second zone, whereby each end of said outlet opening is spaced from the adjacent end of the inlet opening by at least one tooth distance.

* * * * *